US005520240A

United States Patent [19]

Peterle

[11] Patent Number: 5,520,240

[45] Date of Patent: May 28, 1996

[54] DEVICE FOR SUPPORTING LOWER HALF-MOLDS IN SAND CORE MOLDING MACHINES

[76] Inventor: Guido Peterle, Via Novara, 37-28021 Borgomanero, Italy

[21] Appl. No.: 228,635

[22] Filed: Apr. 18, 1994

[30] Foreign Application Priority Data

May 3, 1993 [IT] Italy ..... MI93A0874

[51] Int. Cl.[6] ..... B22C 11/06; B22C 13/12

[52] U.S. Cl. ..... 164/183; 164/186; 164/201

[58] Field of Search ..... 164/186, 183, 164/201, 228

[56] References Cited

U.S. PATENT DOCUMENTS

| | | | |
|---|---|---|---|
| 4,082,134 | 4/1978 | Zachary | 164/186 X |
| 4,100,961 | 7/1978 | Goss et al. | 164/186 X |
| 4,204,569 | 5/1980 | Michelson . | |
| 4,450,888 | 5/1984 | Shibanov et al. . | |
| 4,714,100 | 12/1987 | Bellis et al. | 164/228 X |
| 4,718,474 | 1/1988 | Bellis et al. | 164/228 X |
| 4,830,082 | 5/1989 | Bellis et al. | 164/228 X |

FOREIGN PATENT DOCUMENTS 561461 5/1944 United Kingdom .

OTHER PUBLICATIONS

Patent Abstracts of Japan–vol. 6, No. 48 (M–119) 27 Mar. 1982 & JP–A–56163058 (Toyota Motor Corp) 15 Dec. 1981–abstract.

*Primary Examiner*—J. Reed Batten, Jr.
*Attorney, Agent, or Firm*—Guido Modiano; Albert Josif

[57] ABSTRACT

The device is constituted by a prism-shaped structure which has flat faces, is internally hollow and is rotatably mounted, with preset stops, about a horizontal axis which lies at right angles to the direction of movement of the casting head. A core box is mounted on at least two oppositely arranged faces of the rotating prism-like structure and supports a lower half-mold and associated plates for extracting the finished core; each one of the lower half-molds can be placed in succession, upon rotation of the prism-like structure, at the movable upper half-mold so as to allow, by means of a single upper half-mold, to mold a core in each one of the lower half-molds and to simultaneously extract the previously finished core from the oppositely arranged half-mold.

14 Claims, 2 Drawing Sheets

19
20
18
20
8
4
5
7
II
9a
9
17,17a
12
11
32
12
13
34a
27
34
13
23a
23a
23
38
45
43a
40a
40a
41a
41
39
44
43
39
40
39
44
40
39
42
II
3,3a
2,2a
22
22a
21

DEVICE FOR SUPPORTING LOWER HALF-MOLDS IN SAND CORE MOLDING MACHINES

BACKGROUND OF THE INVENTION

The present invention relates to a prism-shaped intermittently-rotating device for supporting, in equidistant positions, a plurality of lower half-molds of the type used in automatic sand core molding machines in order to allow, with a single upper half-mold, to expel one or more finished cores simultaneously with the molding of another core.

As is known, sand core molding machines use openable molds, i.e. molds constituted by two half-molds arranged opposite to each other in a vertical direction and mounted on supports so that they can be closed by mating, in such a manner that they can be filled with sand, which is injected under pressure through an injection head, and are subsequently opened, normally by spacing one of said half-molds with respect to the other one, in order to allow extraction of the molded core.

The lower half-molds are generally supported by a box-like containment body, commonly termed "core box", which is supported by a quadrangular plate and is removably anchored thereto: said plate has, in its peripheral region, a raised border which has a quadrangular cross-section, so as to form a flat frame for the support and anchoring of the core box; said frame is essentially formed by supporting plates which have a limited width.

In all sand core molding machines that use an upper half-mold movable toward and away from the corresponding half-mold which is mounted in fixed position on the core box, after molding and consequent degassing in a known manner, the upper half-mold is raised, whereas the core, formed in the lower fixed half-mold and partially protruding from the edge of said half-mold, is raised and extracted from the half-mold by means of extractor pins which are carried by two extraction plates actuated in a vertical direction by a hydraulic cylinder. The core is then gripped by clamps or the like and then moved laterally and immersed in a deburring tank or in other devices capable of eliminating burr. The core, thus cleaned, is then removed on trolleys or the like.

In practice, this method of operation entails considerable downtimes between one molding operation and the next. This is due to the need to extract the core when the machine is not moving and to remove said core from the fixed half-mold, and is also due to the time required to close the upper half-mold on the lower half-mold before performing the subsequent injection of the molding sand. Furthermore, the finished core must be extracted with particular care, and its removal requires particular grip means which are rather slow in their intervention and movement.

Due to all these reasons, productivity is limited and production costs are rather high, especially for the production of a limited number of cores using the same metal "pattern" in the lower half-mold.

SUMMARY OF THE INVENTION

Accordingly, the aim of the present invention is to provide a device which rotates in a programmed intermittent manner and can be used on sand core molding machines of the type with a fixed lower half-mold, said device being conceived so as to obviate the drawbacks of known systems and most of all to drastically reduce the downtime required by known machines for the molding and extraction of the finished cores, with evident and significant economical and practical advantages.

Another object of the invention is to provide a rotating device which is structured so that it can be easily used in known machines having vertically-openable molds without requiring onerous and complicated modifications thereof.

A further object of the invention is to provide a device of the above specified type which is conceived so as to allow to easily extract the finished cores without using clamp-like or similar grip means which might damage them irreparably.

With this aim and these objects in view, there is provided, according to the present invention, a device for supporting lower half-molds, which can be used in automatic molding machines of the type having vertically-openable molds including an upper half-mold associated with a molding-sand injection head, mounted for horizontal movement in a reciprocating manner toward the lower half-mold, mounted in fixed position on a core box and having plates for extracting a finished core after lifting the upper half-mold; said device comprising a prism-shaped structure which has flat faces, is internally hollow and rotatably mounted with preset stops, about a horizontal axis which lies at right angles to the direction of movement of said injection head; a core box being mounted on at least two oppositely arranged faces of said rotating prism-like structure, said core box supporting a lower half-mold and associated plates for extracting the finished core; each one of said lower half-molds being arrangeable in succession, upon rotation of said prism-like structure, at the movable upper half-mold so as to allow, by means of a single upper half-mold, to mold a core in each one of said lower half-molds and to simultaneously extract the previously finished core from the oppositely arranged half-mold; means for accommodating each finished core, which are movable toward and away from said half-mold to be unloaded, and means which can move horizontally and vertically to remove the core expelled from the associated half-mold being also provided.

More particularly, said prism-like structure with flat faces is substantially shaped like an internally hollow cubic body and has, on two opposite faces, aligned shafts which protrude centrally from said faces and are mounted so that they can rotate freely within bearings accommodated within the uprights of the molding machine; rotation of said cubic structure is provided by means of a rack meshing with a gear which is rigidly coupled to one of said shafts and is moved in a reciprocating manner by means of a hydraulic cylinder so as to rotate said structure in successive steps with a stop every 180°, i.e. when a lower half-mold is located opposite to the upper half-mold and the opposite half-mold is in the unloading position.

Furthermore, a conventional core box is located on at least two of the faces of the structure which are parallel to its rotation axis; a lower half-mold is removably locked on said core box, and the conventional plates, with extractor pins and associated guides, actuated by a hydraulic cylinder, are provided at the base of said lower half-mold; said hydraulic cylinders are accommodated in mutually opposite positions inside the cavity of said rotating cubic structure.

In the same manner, said means for accommodating and removing the finished core expelled from the half-mold, which is rotated by 180° with respect to the opposite one during molding, are constituted by a roller conveyor which is formed by a series of free rollers which have parallel axes and support a surface or pallet for accommodating the finished core expelled from the inverted half-mold; said rollers are anchored to a horizontal flat frame and simultaneously rotated by means of a hydraulic motor or the like; the roller supporting frame can furthermore be raised and lowered in a reciprocating manner toward and away from said inverted half-mold by means of hydraulic cylinders or the like.

BRIEF DESCRIPTION OF THE DRAWINGS

Further characteristics and advantages of the present invention will become apparent from the following detailed description, given with reference to the accompanying drawings, which are provided merely by way of example and in which.

DESCRIPTION OF THE PREFERRED EMBODIMENTS

Figure 1:
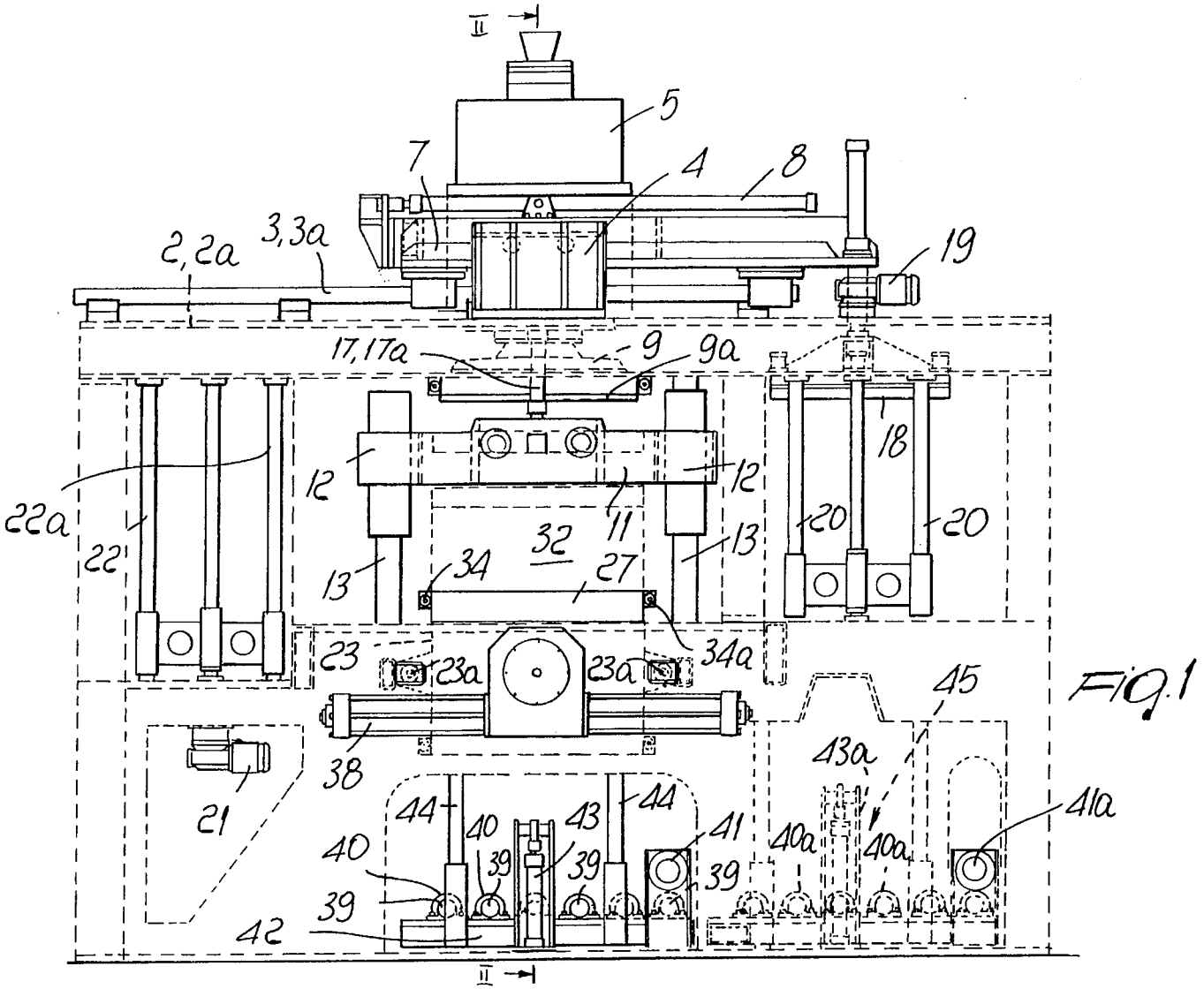
FIG. 1 is a front view of a known core molding machine which includes a rotating mold supporting device and the means for removing the finished cores, all of which are according to the present invention.

With reference to the above figures, the rotating device according to the invention and the associated means for removing the finished core are used in a sand core molding machine of a known type, and more precisely a vertically-arranged machine of the type in which the lower half-mold is fixed and the upper half-mold can move vertically toward and away from the underlying fixed one.

With reference to the above figures, a machine of this type is substantially constituted by box-like vertical sides 1 and 1*a* at the top of which there are two parallel horizontal frames 2–2*a* that support two parallel cylindrical guides 3–3*a;* a cylindrical chamber 4 or head for the injection under pressure of molding sand is movably mounted along said guides; said chamber is fed by an upper hopper 5 provided with a hydraulic cylinder 6 that can close the hopper and the injection head 4 during molding. The injection head 4 is vertically movably mounted along a frame 7 (slideable on said horizontal guides 3–3*a*) and movable from a position in which it lies centrally with respect to the machine, i.e. from the injection position, to a position in which it lies laterally to said machine, by means of a hydraulic cylinder 8. A quadrangular bell-shaped body 9 is connected to the base and coaxially to the injection head 4; said body is closed downwardly by an injection plate 9*a* which has conventional holes for the passage of the sand under pressure into the upper half-mold 10, which is also provided with sand passage holes.

Figure 2:
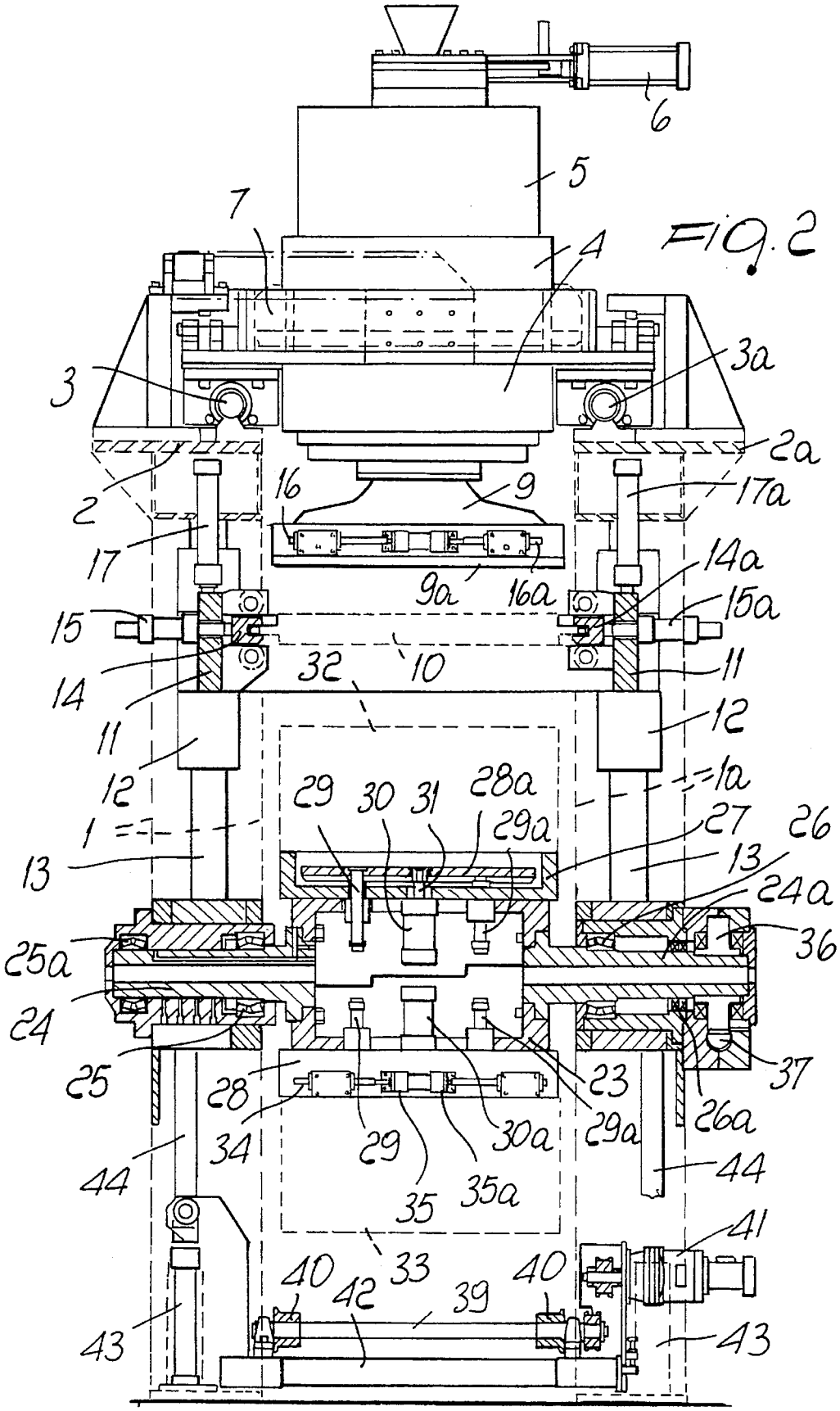
FIG. 2 is a vertical median sectional view of the machine of FIG. 1, taken along the plane II—II of said FIG. 1.

A quadrangular frame 11 is provided below the injection plate 9*a* and has, at its corners, sleeves 12 slideable along vertical guides 13 (FIG. 2).

Two forks 14–14*a* are provided on two opposite sides of the frame 11, more specifically on the two sliding sleeves 12, and are actuated by respective cylinders 15–15*a* that can lock the upper half-mold 10 by insertion of pins that protrude from said half-mold into said forks, whereas after the lowering of the injection plate 9*a* and until contact with the half-mold 10 occurs, other pins 16–16*a,* which are actuated by their own piston and located on the outside of said injection plate, lock the bell and the injection plate to said half-mold. The assembly constituted by the injection plate, by the upper half-mold 10 and by the associated frame 11 is then closed onto the lower half-mold by means of two hydraulic cylinders 17–17*a* (FIG. 2).

The above described known machine is furthermore completed by a gassing plate 18 movable from a position in which it is axially aligned with the molds to a lateral disengagement position; said plate can be lowered by a motor 19 along the guides 20 to facilitate its replacement when necessary. A motor 21 is furthermore provided on the side opposite to that of the gassing plate and, by means of the vertical guides 22–22*a,* allows to lower the injection plate 9*a* when it must be replaced or subjected to maintenance.

A sand core molding machine of the type described above only by way of non-limitative example advantageously includes a device for supporting lower half-molds which allows, with a single upper half-mold which is movable with respect to the lower half-mold, to mold a core in one half-mold while simultaneously expelling and removing one or more finished cores formed earlier in other lower half-molds.

The rotating device according to the present invention is therefore constituted by a hollow prism-like body 23 (FIG. 2) which has flat and parallel faces and substantially forms a cubic hollow body; said body has, on two vertical opposite sides, two shafts 24–24*a* which are coaxial and central with respect to the faces from which they protrude outward. Said two shafts 24–24*a* are mounted so that they can rotate freely within pairs of bearings 25–25*a* and 26–26*a* which are keyed on the opposite sides 1 and 1*a* of the machine. A quadrangular core box 27 and 28 with raised sides is keyed on at least two other opposite faces of the cubic body which are parallel to the rotation axis of the shafts 24 and 24*a;* two conventional expulsion plates 28*a* are arranged within each one of said opposite core boxes and have protruding pins, are guided by cylindrical rods 29 and 29*a,* and can be actuated by their own hydraulic cylinders 30 and 30*a* inserted in opposite positions inside the cavity of the cubic body.

A lower half-mold 32 and respectively 33 is removably anchored, in a known manner, for example by means of a central pin insertable in the holes 31 of the core box, on each one of said opposite core boxes 27; both lower half-molds match the overlying movable upper half-mold 10.

On the outside of each core box 27 and 28 there is a pair of coaxial locking pins or dowels 34–34*a* (FIG. 2) which are actuated by oppositely arranged cylinders 35–35*a* and are suitable to constitute means for centering the half-mold on the respective core box. Two centering pins 23*a* for said cubic body 23 are furthermore provided on two opposite sides thereof.

The cubic body that supports two oppositely arranged lower half-molds is rotated, with preset stops after each rotation through 180°, by means of a cylinder with a rack constituted by a gear 36 that is rigidly coupled to the shaft 24*a* and meshes with a rack 37 (FIG. 2) which is moved in both directions by a cylinder which is generally designated by the reference numeral 38 in FIG. 1. By means of suitable stroke limiters and preset interventions for the cylinder that actuates said rack, the rotation of the rotating body that supports the lower half-molds can be adjusted so as to have one half-mold in molding position and the opposite half-mold rotated through 180° in a position in which it is ready for the expulsion of the finished core that has already been molded in the preceding molding step, with evident significant practical and economic advantages and most of all advantages in terms of reduction in downtime, since the machine can operate continuously without entailing the long idle times required to extract the finished core after each molding operation.

The two shafts 24–24*a* for rotating the cubic body are furthermore axially hollow so as to allow to remove by aspiration any noxious gases, such as solvents used to harden the molding sand, from the cavity of the rotating cubic body.

Below the rotating cubic body 23, i.e. in the region lying under the inverted half-mold with the finished core to be expelled, there is a roller conveyor which is constituted by a series of horizontal and parallel shafts 39 which have, at their opposite ends, rollers 40 which are rigidly associated with the respective shafts 39 and are actuated, simultaneously and under the control of the operator, by a hydraulic motor 41 by means of transmission chains or belts (FIG. 2). Said roller conveyor is supported by a horizontal frame 42 which can be raised and lowered with respect to the inverted upper half-mold 33 by means of two hydraulic cylinders 43. During its reciprocating vertical movements, the roller conveyor is guided along vertical cylindrical rods 44.

A resting surface or pallet is freely placed on the end rollers 40 of the shafts 39 and can be moved by the rotation of the rollers toward the outside of the roller conveyor until it lies on a similar roller conveyor, generally designated by the reference numeral 45 in FIG. 1, for the reasons given hereafter.

In fact, every time a lower half-mold is stopped in inverted position with the finished core protruding downwardly from it, the underlying roller conveyor and the associated frame 42 are raised toward the complementary half-mold by means of the cylinders 43 and then stopped when the pallet (not shown in the figures) is at a short distance from the core; then the expulsion plates 28*a* expel the core from the half-mold, resting it on the underlying pallet; the roller conveyor is then lowered, again by means of the cylinders 43, and in this position, if the core is removed manually, the rollers 40 do not move; if instead the expelled core is removed by virtue of means that intervene automatically, the rollers 40 are rotated by the motor 41 so as to transfer the pallet and the associated core onto the lateral roller conveyor 45. The roller conveyor 45, by means of its own cylinders 43*a*, is then raised to a comfortable manual access level to allow, if required, to remove the core manually, whereas if the core is removed by means of lateral conveyors the rollers 40a are rotated by the associated motor 41*a*, transferring the pallet and the associated core to a removal device.

In this case, since the pallet too is removed from the roller conveyor, the device has a known device for feeding pallets onto the first roller conveyor.

Also according to the invention, instead of two lower half-molds it is possible to apply other half-molds on the remaining flat faces of the rotating hollow body 23, so that said body is stopped at each angular rotation through 90°.

Finally, in its practical execution the invention, as described by way of non-limitative example, is susceptible to other structurally and functionally equivalent modifications and variations without abandoning the protective scope of said invention.

What is claimed is:

1. An intermittently-rotating device for supporting at least two lower half-molds (32,33) in a sand core molding machine, the machine comprising an upper half-mold (10) reciprocally movable into releasable engagement with a lower half-mold, the device comprising:

a rotatable hollow body (23) which is rotatable about a rotation axis;

a first core box (27) and a second core box (28) connected to said hollow body at mutually opposite portions of the hollow body which are spaced approximately 180 degrees apart, each said core box comprising raised sides extending from said hollow body;

a first lower half mold (32) releasably connectable to said first core box and a second lower half mold (33) releasably connectable to said second core box;

a first and second expulsion plate (28*a*) each arranged inside the raised sides of a respective one of said core boxes;

sliding guide rod elements (29,29*a*) connected to each said expulsion plate and extending therefrom into the inside of said hollow body; and a pair of actuation cylinders (30,30*a*) arranged inside said hollow body and each connected to a respective one of said expulsion plates for providing a reciprocal movement to said expulsion plates which are slidingly guided by said sliding guide rod elements.

2. The device of claim 1, further comprising a rotation shaft (24,24*a*) being connected to said hollow body and extending along said rotation axis about which said hollow body is rotatable, wherein said rotation shaft is axially hollow and communicates with the inside of said hollow body so as to allow to remove gases from the inside of said hollow body through said hollow shaft.

3. The device of claim 1, further comprising:

a rotation shaft (24,24*a*) being connected to said hollow body and extending along said rotation axis about which said hollow body is rotatable, a gear (36) mounted on said rotation shaft;

a rack element (37) arranged for meshing with said gear; and an actuation cylinder (38) connected to said rack element for linearly moving said rack element so as to turn said rotation shaft reciprocally through said 180 degrees.

4. The device of claim 1, further comprising:

a first roller conveyor arranged below said hollow body and comprising a first plurality of rotatable horizontal roller shafts (39,40) for supporting a finished core, and a vertically movable first frame (42) rotatably supporting said first shafts;

a first driving element (41) for rotatably driving said first shafts;

a second roller conveyor (45) arranged laterally to said first roller conveyor and comprising a second plurality of rotatable horizontal roller shafts (40*a*) for supporting a finished core transferred from said first roller conveyor, and a vertically movable second frame rotatably supporting said second shafts; and a second driving element (41*a*) for rotatably driving said second shafts.

5. The device of claim 1, further comprising:

a rotation shaft (24,24*a*) being connected to said hollow body and extending along said rotation axis about which said hollow body is rotatable, wherein said rotation shaft is axially hollow and communicates with the inside of said hollow body so as to allow to remove gases from the inside of said hollow body through said hollow shaft;

a gear (36) mounted on said rotation shaft;

a rack element (37) arranged for meshing with said gear; and an actuation cylinder (38) connected to said rack element for linearly moving said rack element so as to turn said rotation shaft reciprocally through said 180 degrees.

6. The device of claim 1, further comprising:

a rotation shaft (24,24*a*) being connected to said hollow body and extending along said rotation axis about which said hollow body is rotatable, wherein said rotation shaft is axially hollow and communicates with the inside of said hollow body so as to allow to remove gases from the inside of said hollow body through said hollow shaft;

a first roller conveyor arranged below said hollow body and comprising a first plurality of rotatable horizontal roller shafts (39,40) for supporting a finished core, and a vertically movable first frame (42) rotatably supporting said first shafts;

a first driving element (41) for rotatably driving said first shafts;

a second roller conveyor (45) arranged laterally to said first roller conveyor and comprising a second plurality of rotatable horizontal roller shafts (40*a*) for supporting a finished core transferred from said first roller conveyor, and a vertically movable second frame rotatably supporting said second shafts; and a second driving element (41*a*) for rotatably driving said second shafts.

7. The device of claim 1, further comprising:

a rotation shaft (24,24*a*) being connected to said hollow body and extending along said rotation axis about which said hollow body is rotatable, a gear (36) mounted on said rotation shaft;

a rack element (37) arranged for meshing with said gear;

an actuation cylinder (38) connected to said rack element for linearly moving said rack element so as to turn said rotation shaft reciprocally through said 180 degrees;

a first roller conveyor arranged below said hollow body and comprising a first plurality of rotatable horizontal roller shafts (39,40) for supporting a finished core, and a vertically movable first frame (42) rotatably supporting said first shafts;

a first driving element (41) for rotatably driving said first shafts;

a second roller conveyor (45) arranged laterally to said first roller conveyor and comprising a second plurality of rotatable horizontal roller shafts (40*a*) for supporting a finished core transferred from said first roller conveyor, and a vertically movable second frame rotatably supporting said second shafts; and a second driving element (41*a*) for rotatably driving said second shafts.

8. The device of claim 1, further comprising:

a rotation shaft (24,24*a*) being connected to said hollow body and extending along said rotation axis about which said hollow body is rotatable, wherein said rotation shaft is axially hollow and communicates with the inside of said hollow body so as to allow to remove gases from the inside of said hollow body through said hollow shaft;

a gear (36) mounted on said rotation shaft;

a rack element (37) arranged for meshing with said gear;

an actuation cylinder (38) connected to said rack element for linearly moving said rack element so as to turn said rotation shaft reciprocally through said 180 degrees;

a first roller conveyor arranged below said hollow body and comprising a first plurality of rotatable horizontal roller shafts (39,40) for supporting a finished core, and a vertically movable first frame (42) rotatably supporting said first shafts;

a first driving element (41) for rotatably driving said first shafts;

a second roller conveyor (45) arranged laterally to said first roller conveyor and comprising a second plurality of rotatable horizontal roller shafts (40*a*) for supporting a finished core transferred from said first roller conveyor, and a vertically movable second frame rotatably supporting said second shafts; and a second driving element (41a) for rotatably driving said second shafts.

9. An intermittently-rotating device for supporting at least two lower half-molds (32,33) in a sand core molding machine, the machine comprising an upper half-mold (10) reciprocally movable into releasable engagement with a lower half-mold, the device comprising:

a rotatable hollow body (23);

a rotation shaft (24,24*a*) being connected to said hollow body and defining an axis about which said hollow body is rotatable; and a first lower half mold (32) and a second lower half mold (33) releasably connectable with said hollow body so as to be arranged mutually opposite and spaced apart by approximately 180 degrees;

wherein said rotation shaft is axially hollow and communicates with the inside of said hollow body so as to allow to remove gases from the inside of said hollow body through said hollow shaft.

10. The device of claim 9, further comprising:

a gear (36) mounted on said rotation shaft;

a rack element (37) arranged for meshing with said gear; and an actuation cylinder (38) connected to said rack element for linearly moving said rack element so as to turn said rotation shaft reciprocally through said 180 degrees.

11. The device of claim 9, further comprising:

a first roller conveyor arranged below said hollow body and comprising a first plurality of rotatable horizontal roller shafts (39,40) for supporting a finished core, and a vertically movable first frame (42) rotatably supporting said first shafts;

a first driving element (41) for rotatably driving said first shafts;

a second roller conveyor (45) arranged laterally to said first roller conveyor and comprising a second plurality of rotatable horizontal roller shafts (40*a*) for supporting a finished core transferred from said first roller conveyor, and a vertically movable second frame rotatably supporting said second shafts; and a second driving element (41*a*) for rotatably driving said second shafts.

12. An intermittently-rotating device for supporting at least two lower half-molds (32,33) in a sand core molding machine, the machine comprising an upper half-mold (10) reciprocally movable into releasable engagement with a lower half-mold, the device comprising:

a rotatable hollow body (23);

a rotation shaft (24,24*a*) being connected to said hollow body and defining an axis about which said hollow body is rotatable;

a first lower half mold (32) and a second lower half mold (33) releasably connectable with said hollow body so as to be arranged mutually opposite and spaced apart by approximately 180 degrees;

a gear (36) mounted on said rotation shaft;

a rack element (37) arranged for meshing with said gear; and an actuation cylinder (38) connected to said rack element for linearly moving said rack element so as to turn said rotation shaft reciprocally through said 180 degrees.

13. The device of claim 12, further comprising:

a first roller conveyor arranged below said hollow body and comprising a first plurality of rotatable horizontal roller shafts (39,40) for supporting a finished core, and a vertically movable first frame (42) rotatably supporting said first shafts;

a first driving element (41) for rotatably driving said first shafts;

a second roller conveyor (45) arranged laterally to said first roller conveyor and comprising a second plurality of rotatable horizontal roller shafts (40*a*) for supporting a finished core transferred from said first roller conveyor, and a vertically movable second frame rotatably supporting said second shafts; and a second driving element (41*a*) for rotatably driving said second shafts.

14. An intermittently-rotating device for supporting at least two lower half-molds (32,33) in a sand core molding machine, the machine comprising an upper half-mold (10) reciprocally movable into releasable engagement with a lower half-mold, the device comprising:

a rotatable hollow body (23) which is rotatable about a rotation axis;

a first lower half mold (32) and a second lower half mold (33) releasably connectable with said hollow body so as to be arranged mutually opposite and spaced apart by approximately 180 degrees;

a first roller conveyor arranged below said hollow body and comprising a first plurality of rotatable horizontal roller shafts (39,40) for supporting a finished core, and a vertically movable first frame (42) rotatably supporting said first shafts;

a first driving element (41) for rotatably driving said first shafts;

a second roller conveyor (45) arranged laterally to said first roller conveyor and comprising a second plurality of rotatable horizontal roller shafts (40*a*) for supporting a finished core transferred from said first roller conveyor, and a vertically movable second frame rotatably supporting said second shafts; and a second driving element (41*a*) for rotatably driving said second shafts.

* * * * *